US010309715B2

(12) United States Patent
Kim

(10) Patent No.: US 10,309,715 B2
(45) Date of Patent: Jun. 4, 2019

(54) REFRIGERATOR

(71) Applicant: Dongbu Daewoo Electronics Corporation, Seoul (KR)

(72) Inventor: Tae Jin Kim, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/934,393

(22) Filed: Mar. 23, 2018

(65) Prior Publication Data

US 2018/0299187 A1 Oct. 18, 2018

(30) Foreign Application Priority Data

Apr. 13, 2017 (KR) ..... 10-2017-0047912

(51) Int. Cl.
*E05B 1/00* (2006.01)
*F25D 23/02* (2006.01)

(52) U.S. Cl.
CPC ..... *F25D 23/028* (2013.01); *E05B 1/0015* (2013.01); *E05B 2001/0023* (2013.01)

(58) Field of Classification Search
CPC .. F25D 23/028; F25D 2323/02; E05B 1/0015; E05B 2001/0023; E05B 5/003; E05B 5/006
See application file for complete search history.

(56) References Cited

U.S. PATENT DOCUMENTS 3,648,411 A * 3/1972 Saunders ..... E05B 1/0015 16/412
5,906,423 A * 5/1999 Lyu ..... F25D 17/047 220/231
7,556,324 B2 * 7/2009 Benz ..... F25D 17/047 16/412
2003/0126721 A1 * 7/2003 Panek ..... A45C 13/26 16/409
2003/0145433 A1 * 8/2003 Mandel ..... E05B 1/0015 16/436

(Continued)

FOREIGN PATENT DOCUMENTS

KR 200194914 Y1 9/2000

OTHER PUBLICATIONS

Hwan Geum Kim; "Door-Handle of a Refrigerator"; Bibliographic Data of KR200194914 (Y1); Jun. 26, 2000; http://espacenet.com.

*Primary Examiner* — Daniel J Rohrhoff
(74) *Attorney, Agent, or Firm* — Andrew D. Fortney; Central California IP Group, P.C.

(57) ABSTRACT

Disclosed is a refrigerator. The refrigerator may include a main body having a storage space configured to store food, a door configured to selectively open and shield or close the storage space of the main body and including a first accommodation groove on one side and/or end and a second accommodation groove on another side and/or end, and a handle in or on a front side of the door, configured to be held by a user and including a first portion rotatably fixed or attached to a pivot in the first accommodation groove and a second portion in the second accommodation groove or withdrawn from the second accommodation groove by rotation of the first portion. The second portion is capable of being fixed or attached to a fixing member in the second accommodation groove when the second portion is withdrawn from the second accommodation groove.

11 Claims, 4 Drawing Sheets

(56) References Cited

U.S. PATENT DOCUMENTS

| | | | | |
|---|---|---|---|---|
| 2005/0066479 | A1* | 3/2005 | Kim | E05B 1/0015 16/436 |
| 2006/0143865 | A1* | 7/2006 | Magyar | A47B 95/02 16/412 |
| 2008/0047108 | A1* | 2/2008 | Yu | A45C 13/22 16/408 |
| 2009/0015124 | A1* | 1/2009 | Yang | A47B 95/02 312/405 |
| 2012/0280608 | A1* | 11/2012 | Park | E05B 1/0015 312/405 |
| 2013/0000345 | A1* | 1/2013 | Vitan | F25C 5/005 62/344 |
| 2015/0115785 | A1* | 4/2015 | Allen | E05B 1/0015 312/319.2 |
| 2017/0051542 | A1* | 2/2017 | Reske | E05B 63/244 |
| 2017/0167163 | A1* | 6/2017 | Giacomini | E05B 1/0015 |

* cited by examiner

REFRIGERATOR

TECHNICAL FIELD

The present disclosure relates to a refrigerator.

BACKGROUND

A refrigerator is an apparatus aimed at the low-temperature storage of food and is configured for the cold storage or freezing storage of food. To this end, the refrigerator may include a cooling apparatus in which a cooling or refrigeration cycle has been implemented. The cooling apparatus is configured so that a refrigerant undergoes a compression-condensation-expansion-evaporation process. Cool air is generated as the refrigerant circulates in the cooling cycle. The cool air generated by the evaporator of the cooling apparatus is supplied to the storage space of the refrigerator. Food within the refrigerator may be stored under a required temperature condition as the cool air supplied to the storage space of the refrigerator is circulated by convection current. In general, the main body of the refrigerator has a rectangular shape having an open front, and the inside of the main body includes a cold room and a freezing room. Furthermore, a cold room door and freezing room door for selectively closing or shielding a corresponding opening is provided at the front of the main body.

The refrigerator may be basically divided into a top-mount type in which the freezing room is above the cold room, a bottom freezer type in which the freezing room is below the cold room, and a side-by-side type in which the freezing room and the cold room are laterally adjacent to one another and partitioned depending on the location of the freezing room and the cold room.

A handle capable of being held by a user is in or on the door of the refrigerator, and thus a user can open and shut the door of the refrigerator. In general, the handle of the door of the refrigerator extends from the front of the door so that the user can hold the handle. There is a danger that the handle may be damaged due to a collision or impact when the refrigerator is packaged and/or carried because the handle extends from the refrigerator as described above.

In a conventional technology, in order to solve this problem, the handle is packaged and carried separately when from the door, and a service technician or consumer directly assembles the handle after the refrigerator is delivered.

When assembling the handle and the door, the service technician or user may apply excessive force to the handle and the door when a plurality of screws are fixed to the door and the handle, or the handle is inserted into and/or fixed to a fastening hole in the door. Accordingly, when the handle and the door are assembled, a problem involving a defective handle, damage to the handle, or the damage to the door attributable to erroneous assembly may occur.

PRIOR ART DOCUMENT

Patent Document

Patent Document: Korean Utility Model No. 20-0194914 (Jun. 26, 2000)

SUMMARY

Embodiments of the present disclosure provide a refrigerator having a low risk to the handle of the door when the refrigerator is packaged and shipped.

Furthermore, embodiments of the present disclosure provide a refrigerator in which a door handle can be accurately fixed at its intended position when the handle is installed.

In accordance with an aspect of the present invention, there may be provided a refrigerator, including a main body having a storage space configured to store food, a door configured to selectively open and shield or close the storage space of the main body and including a first accommodation groove on one side and/or end of the door and a second accommodation groove on another other side and/or end of the door, and a handle in or on a front side of the door configured to be held by a user and including a first portion rotatably fixed to a pivot in the first accommodation groove and a second portion in or withdrawn from the second accommodation groove by rotation of the first portion, wherein the second portion is configured to be fixed or attached to a fixing member in the second accommodation groove when the second portion is withdrawn from the second accommodation groove.

Furthermore, the storage space may include a cold room and a freezing room, the door may include a cold room door, the refrigerator further includes a freezing room door, the cold room door includes the handle, and the freezing room door includes a similar or functionally identical handle.

Furthermore, the first accommodation groove may be adjacent or near to the upper or lower side or end of the main body, and the second accommodation groove may be adjacent or near to the center of the main body (e.g., along a height of the main body).

Furthermore, the first portion may comprise a first end and/or side of the handle, the second portion may comprise a second end and/or side of the handle (e.g., an opposite end and/or side), the first accommodation groove may comprise a space into which the first portion is insertable and rotatable, and the second accommodation groove may comprise a space in which the second portion is insertable.

Furthermore, the pivot may be horizontal and may intersect the first accommodation groove, and the fixing member may extend from an inside surface of the second accommodation groove and have an end extending beyond the front side of the refrigerator.

Furthermore, the second portion may be movable when the second portion surrounds the fixing member, and the second portion may be fixed to the end of the fixing member extending beyond the front of the refrigerator by a fastening member when the second portion is withdrawn from the second accommodation groove.

Furthermore, the second portion may include at least two fastening holes configured to be fixed or attached to the fixing member and spaced apart from each other, one of the fastening holes may couple the second portion and the fixing member when the second portion is in the second accommodation groove, and another one of the fastening holes may couple the second portion and the fixing member when the second portion is withdrawn from the second accommodation groove.

In accordance with an embodiment of the present disclosure, there is provided a refrigerator configured to store food at low temperature, including a main body having a storage space configured to store food, a door configured to selectively open and shield or close the storage space of the main body, and a handle having a first end and/or side rotatably fixed to the door and a second end and/or side adjacent or near to or distant from the front side of the door. The handle is in a first state when the second end and/or side is adjacent or near to the front of the door and a second state when the second end and/or side is far or away from the front side of the door. When the refrigerator is packaged and shipped, the handle is in the first state, and when the refrigerator is installed or in use, the handle is in the second state and is fixed to the door.

Furthermore, the first end and/or side of the handle may be connected to a pivot in a first accommodation groove on or in a first section of the door, and the second end and/or side of the handle may be in or withdrawn from a second accommodation groove on or in a second section of the door.

Furthermore, the second end and/or side may include a guide extending toward the door, the second accommodation groove includes a space in which the guide is movable, and the guide is fixed or attached to a fixing member extending from an inside surface of the second accommodation groove by a fastening member in the second state.

Furthermore, an end of the fixing member extends beyond the front side of the door, and the fastening member is coupled to the end of the fixing member.

Furthermore, the handle may be fixed to the door when the handle is in the first state.

Furthermore, the storage space may include a cold room and a freezing room, the door may include a cold room door, the refrigerator may further include a freezing room door, the cold room door may include the handle, the freezing room door may have a second handle having a first end and/or side rotatably fixed to the freezing room door and a second end and/or side adjacent or near to or distant from a front side of the freezing room door, wherein the second handle is in the first state when the second end and/or side thereof is adjacent or near to the front side of the freezing room door and in the second state when the second end and/or side thereof is far or away from the front side of the freezing room door, and the first end may be adjacent or near to the upper or lower side or end of the main body.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Hereinafter, specific embodiments of the present disclosure will be described in detail with reference to the drawings.

In addition, in the description of the present disclosure, the detailed description of known functions and configurations incorporated herein may be omitted if they would unnecessarily obscure features of the subject matter of the present disclosure.

Figure 1:
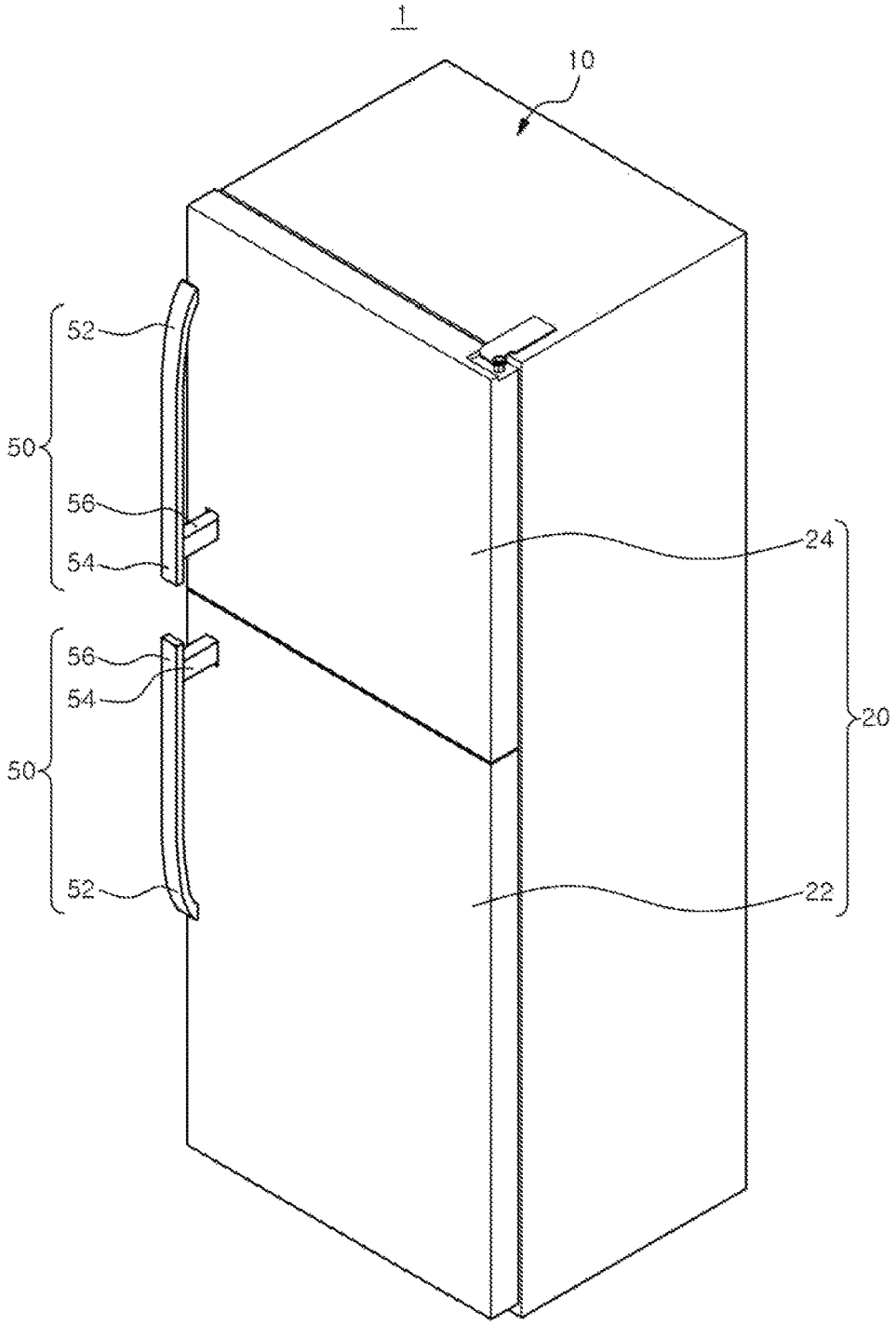
FIG. 1 is a perspective view of a refrigerator according to an embodiment of the present disclosure.
Figure 2:
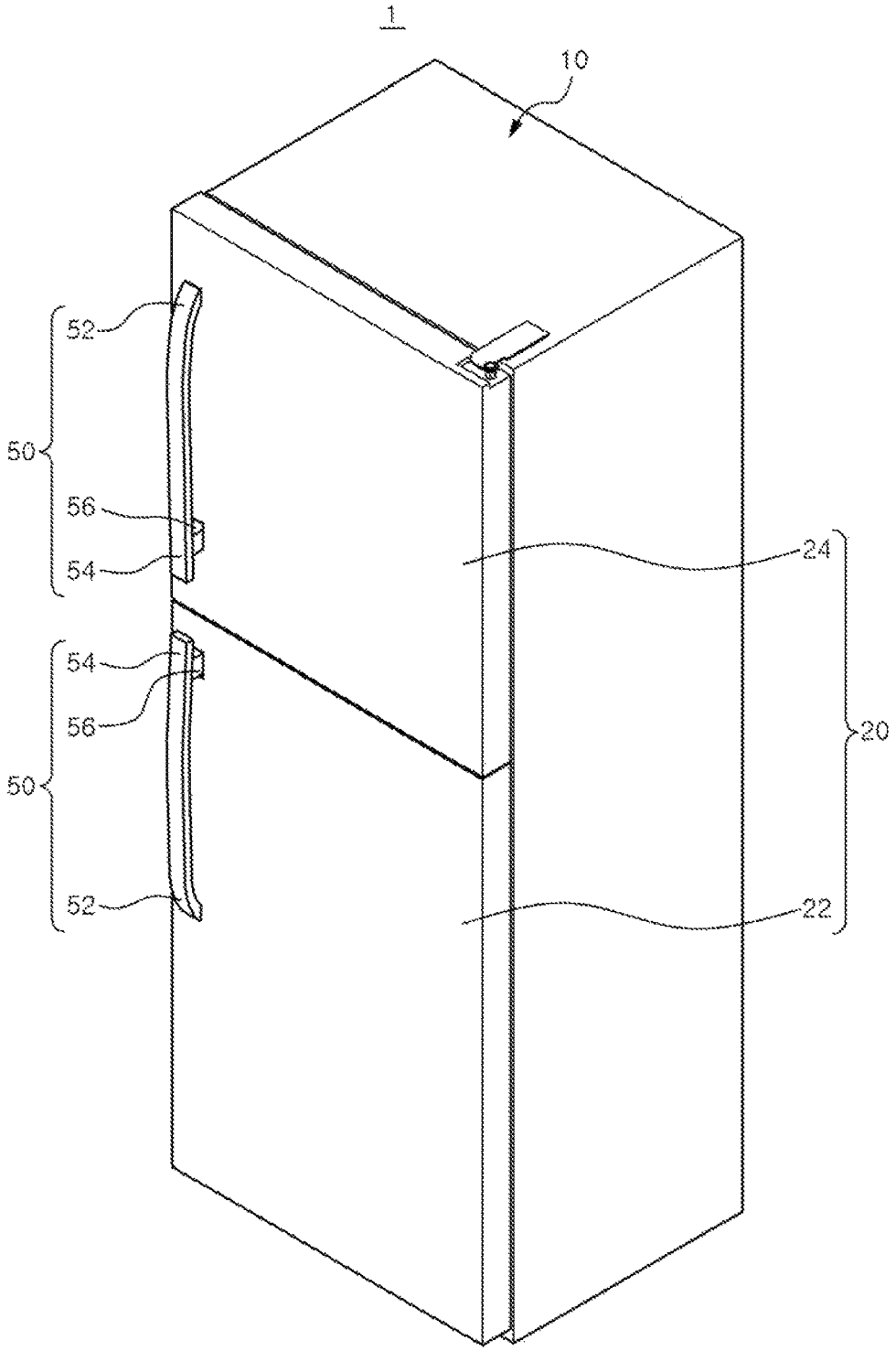
FIG. 2 is a perspective view showing the handle of the refrigerator of FIG. 1 inserted into a door.
Figure 3:
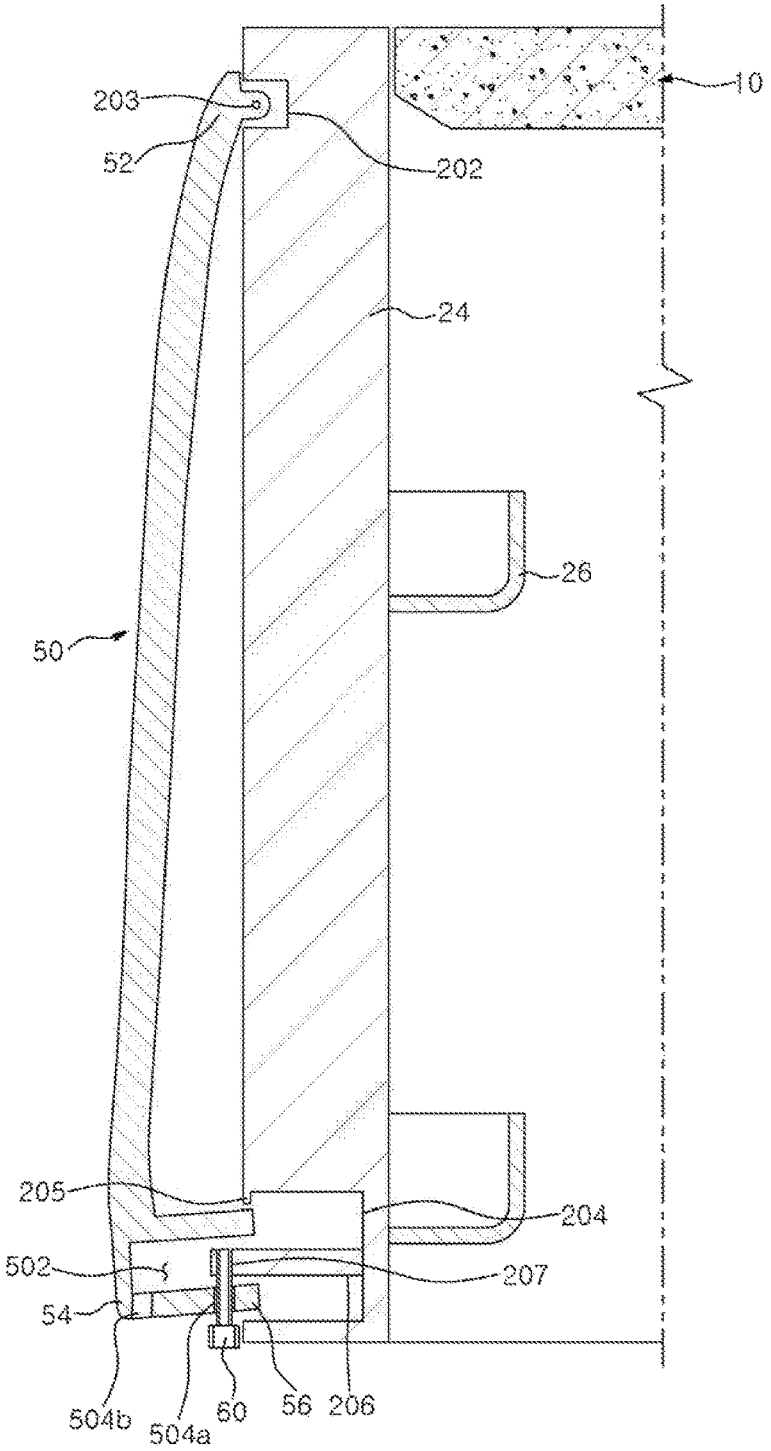
FIG. 3 is a cross-sectional view of a handle as shown in FIG. 1.
Figure 4:
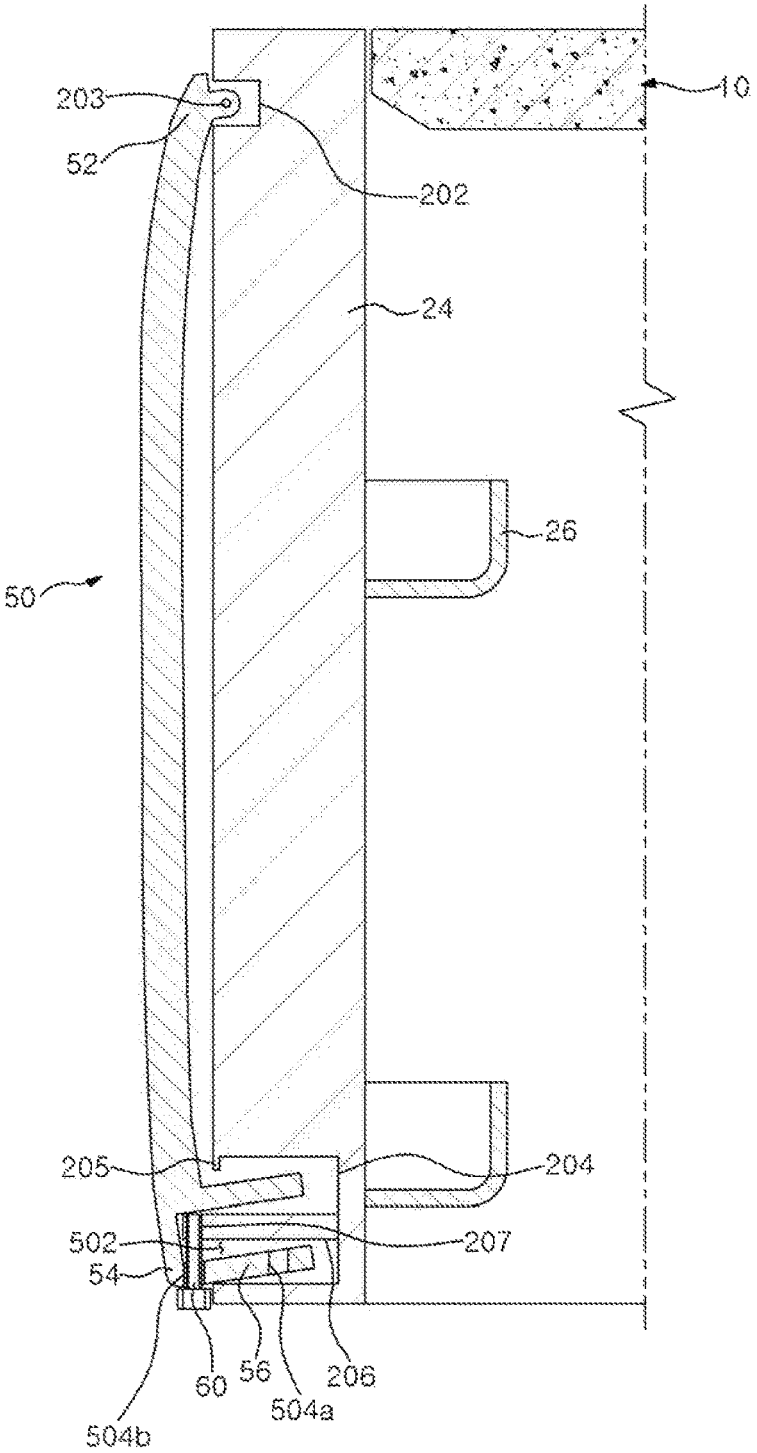
FIG. 4 is a cross-sectional view of the handle as shown in FIG. 2.

FIG. 1 is a perspective view of a refrigerator according to an embodiment of the present disclosure. FIG. 2 is a perspective view showing the handle of the refrigerator of FIG. 1 inserted into a door. FIG. 3 is a cross-sectional view of a handle as shown in FIG. 1. FIG. 4 is a cross-sectional view of a handle as shown in FIG. 2.

Referring to FIGS. 1 to 4, the refrigerator 1 according to an embodiment of the present disclosure is for keeping food in a low-temperature state. The refrigerator 1 may include a main body 10 configured to have a storage space for food therein, a door 20 in front of the main body 10 configured to rotatably move and selectively open and close or shield the storage space, and a handle 50 in or on the front of the door 20 and capable of being held by a user.

In one embodiment, a top-mount refrigerator 1 in which a freezing room is over a cold room is illustrated, but the spirit of the present disclosure is not limited thereto. The present disclosure may also be applied to bottom freezer type and side-by-side type refrigerators.

Specifically, the main body 10 includes one or more storage spaces for food, and has an open front that is selectively shielded by the door 20. In this case, the front of the main body 10 means an open surface that can be shielded by the door 20. Furthermore, the main body 10 may include the cold room including a cool space and the freezing room including a freezing space, depending on the temperature or the room and/or space. In this case, both the cool space and the freezing space have open fronts and may be selectively shielded by separate doors 20.

The door 20 selectively shields the storage space of the main body 10, and one or more doors may be coupled to the main body 10. Specifically, the door 20 may include a cold room door 22 and freezing room door 24, each fixed or attached to one side of the main body 10 in such a way as to rotatably move and be capable of selectively opening and shielding or closing a corresponding room. Furthermore, a plurality of baskets 26 capable of accommodating food may be in or on the back of the door 20. A user can efficiently keep food in the storage space within the refrigerator using the food storage devices therein, such as a shelf, a storage box, or the basket 26.

Furthermore, the handle 50 capable of being held by a user may be in or on the front of the door 20 so that the user can selectively shield the door 20. A first accommodation groove 202 and second accommodation groove 204 to be coupled to the handle 50 may be in the door 20. The first accommodation groove 202 and the second accommodation groove 204 may be in each of the cold room door 22 and the freezing room door 24.

The handle 50 may be in or on the front of each of the cold room door 22 and the freezing room door 24 so that a user can hold the handle 50. One end and/or side of the handle 50 may be rotatably fixed to the door 20, and another end and/or side of the handle 50 may become closer or distant from the front of the door 20, depending on the rotation of the one end and/or side. The handle 50 may include a first portion 52 forming the one end and/or side of the handle 50 and a second portion 54 forming the other end and/or side of the handle 50, and may further include a guide 56 extending from the second portion 54 to the door 20.

The first portion 52 may be partially inserted and rotatably fixed to and/or in the first accommodation groove 202, and the second portion 54 may be inserted into or withdrawn from the second accommodation groove 204 in response to the rotation of the first portion 52. Specifically, the guide 56 extending from the second portion 54 may be inserted into or withdrawn from the second accommodation groove 204. As described above, the second portion 54 of the handle 50 is inserted into or withdrawn from the door 20 by the rotation of the first portion 52, and thus the other end and/or side of the handle 50 can be adjacent or near to the front of the door 20 or extended in front of the door 20, with an interval between the two positions.

Furthermore, a hollow portion 502 may be in the second portion 54, by which the second portion may be inserted into or withdrawn from the second accommodation groove 204. A fixing member 206 extending from the door 20 may be in the hollow portion 502.

Furthermore, the second portion 54 may include at least two fastening holes 504*a* and 504*b*, spaced apart from each other so that the second portion 54 can be adjustably fixed to the fixing member 206 extending from the door 10. The fastening holes 504*a* and 504*b* are in the bottom of the hollow portion 502 of the second portion 54, so a fastening member 60 can be inserted into the fastening hole. In this case, the first fastening hole 504*a* may be relatively close to the second accommodation groove 204, and the second fastening hole 504*b* may be relatively close to the handle 50.

The fastening member 60 is fixed to and/or secured in (i) one of the fastening holes 504*a* and 504*b* of the second portion 54 and (ii) the fixing member 206, thereby being capable of fixing the position of the second portion 54 as inserted or withdrawn. Various coupling means, such as a bolt, may be used as the fastening member 60. In one embodiment, a bolt is illustrated.

The first accommodation groove 202 and the second accommodation groove 204 are grooves or depressions in which to mount the handle 50 on the door 20. The first portion 52 of the handle 50 may be received in the first accommodation groove 202. The second portion 54 of the handle 50 may be received in the second accommodation groove 204. The first accommodation groove 202 and the second accommodation groove 204 may be on a straight line along the length of the refrigerator 1. In one embodiment, an upward direction and a downward direction may be related to the upper side and the lower side of the handle shown in FIG. 3. The upward and downward directions may be vertical directions, and the left and right directions as shown in FIG. 3 may be horizontal directions. Furthermore, the first accommodation groove 202 and the second accommodation groove 204 receive the first portion 52 and second portion 54 of the handle 50, respectively. The distance from the first accommodation groove 202 to the second accommodation groove 204 may correspond to the distance from the first portion 52 of the handle 50 to the second portion 54.

Furthermore, the first accommodation groove 202 may be adjacent or near to the upper or lower side or end of the main body 10, and the second accommodation groove 204 may be adjacent or near to the center of the main body 10 (e.g., along the height of the refrigerator 1). Specifically, the first accommodation groove 202 in the cold room door 22 may be adjacent or near to the lower side or end of the main body 10, and the second accommodation groove 204 may be adjacent or near to the center of the main body 10. Likewise, the first accommodation groove 202 in the freezing room door 24 may be adjacent or near to the upper side or end of the main body 10, and the second accommodation groove 204 may be adjacent or near to the center of the main body 10. Accordingly, the second portions 54 of the handles 50 in the cold room door 22 and the freezing room door 24, respectively, may face or be adjacent to each other. Accordingly, when a user holds the handle 50, a portion held by the user extends in front of the door and may be at or near the center of the main body 10, so the user can easily hold the extended portion of the handle 50. However, the spirit of the present disclosure is not limited to such a configuration. For example, the first accommodation groove 202 may be on or in the upper side or end of each of the cold room door 22 and the freezing room door 24, and the second accommodation groove 204 may be on or in the lower side or end of each of the cold room door 22 and the freezing room door 24. The locations of the first accommodation groove 202 and the second accommodation groove 204 are not limited thereto, and may vary depending on the type of refrigerator and the environment of the user.

The first accommodation groove 202 may include a first space into which the first portion 52 is insertable and in which the first portion 52 rotates. Furthermore, a pivot 203 providing a rotation axis for the first portion 52 may be in the first accommodation groove 202.

The pivot 203 may be horizontal and may intersect the internal space of the first accommodation groove 202. For example, the pivot 203 may horizontally intersect the center of the internal space of the first accommodation groove 202. The location of the pivot 203 is not limited to the center of the internal space of the first accommodation groove 202, and may be at a location where the first portion 52 can rotate without interference with the inside surface of the first accommodation groove 202.

The second accommodation groove 204 may include a second space into which the second portion 54 is insertable and from which the second portion 54 can be withdrawn. Specifically, the second accommodation groove 204 may be configured to allow the guide 56 extending from the second portion 54 to the front of the door 10 to move (e.g., rotate). When the second portion 54 is inserted into the second accommodation groove 204, the second portion 54 may be inserted by the rotation of the first portion 52. Accordingly, the second portion 54 is not inserted in a straight line in response to the rotation of the first portion 52, but may be inserted into the second accommodation groove 204 in the form of a curved or diagonal line (e.g., an arc) according to the turning radius of the second portion 52. The second accommodation groove 204 may include a space configured to receive the second portion 54 that is inserted in a diagonal or curved direction. The second accommodation groove 204 may have a greater width or height than the second portion 54 inserted into the second accommodation groove 204 and may include an empty space or cavity.

In this case, a protrusion 205 may extend along the front of the door 10 in the upper part of the second accommodation groove 204. If the front of the door 10 includes a large hole or opening at the surface of the second accommodation groove 204, a malfunction problem may occur because foreign substances may accumulate within the second accommodation groove 204. Accordingly, the protrusion 205 may block the front of the empty space in the second accommodation groove 204. The protrusion 205 may have a length and location that does not interfere with the second portion 54 when the second portion 54 is inserted into or withdrawn from the second accommodation groove 204. However, the embodiments are not limited to the protrusion 205 shown, and the protrusion 205 may not be required.

Furthermore, the fixing member 206 for fixing or attaching the second portion 54 may be in the second accommodation groove 204. The fixing member 206 extends from the inside surface of the second accommodation groove 204, and may extend beyond a front surface of the refrigerator 1. The second portion 54 inserted into or withdrawn from the second accommodation groove 204 may be fixed or attached to the fixing member 206. Alternatively, the second portion 54 may be held in place by the guide 56 and/or fastening member 60 passing through the fastening hole 207 in the fixing member 206. In order to fix or secure the position of the second portion 54, the fixing member 206 may include a fastening hole 207 configured to fasten or secure the fastening member 60 when inserted through a fastening hole 504*a* or 504*b* in the second portion 54.

The fastening hole 207 may be at the end of the fixing member 206 that extends beyond the front surface of the door 20.

An operation and effects of the refrigerator 1 configured as described above according to an embodiment of the present disclosure are described below.

The handle may have a first portion rotatably fixed to the door and a second portion adjacent or near to or distant from a front side of the door. The refrigerator 1 according to one embodiment may be in a first state when the second portion 54 of the handle 50 is adjacent or near to the front side of the door 20, and may be in a second state when the second portion 54 is farther from the front of the door. Furthermore, when the refrigerator 1 is packaged and/or shipped, the handle 50 is in the first state. When the refrigerator 1 is installed or in use, the handle 50 is in the second state and may be fixed to the door 20.

An end of the first portion 52 of the handle 50 is inserted into the first accommodation groove 202. The pivot 203 in the first accommodation groove 202 may be connected to the center of the end of first portion 52 inserted into the first accommodation groove 202. Accordingly, the first portion 52 can rotate around the pivot 203. In this case, the direction in which the first portion 52 rotates may be in one direction along a curved line (e.g., an arc some distance from the pivot 203), for example from the upper side to the lower side, from the first accommodation hole 202 to the second accommodation hole 204, etc. When the first portion 52 rotates downward (e.g., toward the refrigerator 1), the second portion 54 is inserted into the second accommodation hole 204. When the first portion 52 rotates upward (e.g., away from the refrigerator 1), the second portion 54 may be withdrawn from the second accommodation hole 204. This may correspond to the driving of the first portion 52 and the second portion 54. The insertion or withdrawal of the second portion 54 is not limited by the rotation of the first portion 52, but the first portion 52 may be rotated by the insertion or withdrawal of the second portion 54. Specifically, in order to insert or withdraw the second portion 54, the first portion 52 may be rotated. For example, in order to insert or withdraw the second portion 204, a user may push or pull the second portion 204 (e.g., after removal of the fastening member 60 from the fastening holes 504*a-b*). The second portion 204 may be inserted or withdrawn by a force when the user pushes or pulls the second portion 204, thus rotating the first portion 202 around the pivot 203.

The second portion 54 may move when it surrounds the fixing member 206. Specifically, when the fixing member 206 is placed in the cavity of the second portion 54, the second portion 54 may be inserted or withdrawn. The cavity in the second portion 54 may extend beyond the front of the door 10, and thus the second portion 54 may move when the hollow portion surrounds the end of the fixing member 206 having the fastening hole 207 therein. Accordingly, the second portion 54 may be fixed, attached or secured to the end of the fixing member 206 by the fastening member 60 when the second portion 54 has been withdrawn from or inserted into the second accommodation groove 204.

The second portion 54 may be in the first state (e.g., the inserted state) or the second state (e.g., the withdrawn state) by inserting the fastening member 60 first into the first fastening hole 504*a* or the second fastening hole 504*b* in the second portion 54, then into the fastening hole 207 in the fixing member 206. Specifically, the second fastening hole 504*b* may be used to fix or attach the second portion 54 and the fixing member 206 in the first state (i.e., when the second portion 54 has been inserted into the second accommodation groove 204). The first fastening hole 504*a* may be used to fix or attach the second portion 54 and the fixing member 206 in the second state (i.e., when the second portion 54 has been withdrawn from the second accommodation groove 204).

When the handle 50 is to be inserted, the fastening member 60 is not in the fastening hole 207 (although an end of the fastening member 60 farthest from the guide 56 may be in the second fastening hole 504*b*), a push force is applied to the second portion 54, the first portion 52 rotates, the second portion 54 is inserted into the second accommodation groove 204, the fastening member 60 is passed through or threaded into the second fastening hole 504*b* in the second portion 54, and then into and/or through the fastening hole 207 in the fixing member 206, thereby fixing, attaching or securing the second portion 54 in the second accommodation groove 204 (the first state).

Likewise, when the handle 50 is to be withdrawn, the fastening member 60 is not in the fastening hole 207 (although an end of the fastening member 60 farthest from the guide 56 may be in the first fastening hole 504*a*), a pull force is applied to the second portion 52, the first portion 52 rotates, the second portion 54 is withdrawn from the second accommodation groove 204, the fastening member 60 is passed through or threaded into the first fastening hole 504*a* in the second portion 54, and then into and/or through the fastening hole 207 in the fixing member 206, thereby thus fixing, attaching or securing the second portion 54 to the door when withdrawn from the second accommodation groove 204 (the second state).

In the example in which the guide 56 and the fastening member 60 together comprise a bolt with a hexagonal head, each of the fastening holes 207 and 504*a-b* may be threaded to match or mate with the fastening member 60. Alternatively, either (i) the fastening hole 207 may be threaded to match or mate with the fastening member 60, and the fastening holes 504*a-b* may be smooth, cylindrical openings through the second portion 54 having a diameter slightly greater than that of the fastening member 60, or (ii) the fastening holes 504*a-b* may be threaded to match or mate with the fastening member 60, and the fastening hole 207 may be a smooth, cylindrical opening through the fixing member 206 having a diameter slightly greater than that of the fastening member 60. Thus, at least one of the fastening holes 207 and 504*a-b* may be threaded to match or mate with the fastening member 60 when the guide 56 and the fastening member 60 together comprise a bolt with a head.

In this case, each of the first fastening hole 504*a* and the second fastening hole 504*b* may independently pass through the second portion 54 at an angle such that the fastening member 60 may be inserted into the fastening hole 207 when the second portion 54 is inserted into or withdrawn from the second accommodation groove 204. For example, the fastening member 60 may be attached to the second portion 54 using the first fastening hole 504*a* when the second portion 54 has been withdrawn from the second accommodation groove 204. When the second portion 54 has been withdrawn from the second accommodation groove 204, parts of the second portion 54 entering the accommodation groove 204 are horizontal or parallel with the fixing member 206. For this reason, the axis along the depth of the first fastening hole 504*a* may be at an angle of 90 degrees with respect to the direction in which the fixing member 206 is oriented.

In contrast, the fastening member 60 may be attached to the second portion 54 using the second fastening hole 504*b* when the second portion 54 has been inserted into the second accommodation groove 204. When the second portion 54 is inserted into the second accommodation groove 204, the second portion 54 may move a curved line (e.g., an arc) by the rotation of the first portion 52. Accordingly, the axis along the depth of the second fastening hole 504*b* may have an angle bent slightly right or left (e.g., 75° to 85°) with respect to the direction in which the fixing member 206 is oriented, so the fastening member 60 may be easily fixed to the second fastening hole 504*b*.

In accordance with at least one embodiment, when the refrigerator 1 is packaged and shipped, the handle 50 is inserted into the door 20 as shown in FIGS. 2 and 4. Accordingly, the depth and/or distance of the handle 50 from the main body 10 can be reduced. Accordingly, when the refrigerator 1 is shipped, the handle 50 can be safely delivered without being damaged. When the delivery is complete, the handle 50 may be pulled away from the door 20 as shown in FIGS. 1 and 3. If the handle 50 is to be withdrawn, when a service technician or user pulls the second portion 54, the first portion 52 rotates from the pulling force, and thus the second portion 54 may be withdrawn. The location or position of the handle 50 may be fixed or attached using the fastening member 60 when the second portion 54 has been withdrawn. As described above, the withdrawn state of the handle 50 is easily fixed or secured using the fastening member 60 after pulling out the inserted second portion 54. Accordingly, since assembly becomes simpler, the risk of damage may be reduced when a service technician or a user directly assembles the handle 50.

In accordance with the refrigerator according to an embodiment of the present disclosure, there is an advantage in that the refrigerator may be shipped without the handle of the door of the refrigerator being damaged when the refrigerator is packaged and shipped.

Furthermore, there is an effect in that the handle can be precisely fixed or attached when the refrigerator is installed.

Although the refrigerator according to an embodiment of the present disclosure has been described in detail, this is merely illustrative of the technical idea of the present disclosure and various changes and modifications may be made without departing from the essential characteristics of the present disclosure. Therefore, the embodiments described in the present disclosure are not intended to limit the scope of the present disclosure, but are intended to illustrate and not limit the scope of the present disclosure. The scope of protection of the present disclosure should be construed according to the following claims, and all technical ideas which are equivalent or equivalent thereto should be interpreted as being included in the scope of the present disclosure.

What is claimed is:

1. A refrigerator, comprising:

a main body having a storage space configured to store food;

a door configured to selectively open and shield or close the storage space, comprising a first accommodation groove on or in one side or end of the door and a second accommodation groove on or in another side or end of the door; and a first handle in or on a front side of the door, configured to be held by a user and comprising a first portion rotatably fixed or attached to a first pivot in the first accommodation groove and a second portion in the second accommodation groove or withdrawn from the second accommodation groove by rotation of the first portion, wherein the first portion ends at a first side of the handle, the first accommodation groove includes a first space in which the first portion is insertable and rotatable, the first pivot is horizontal and intersects the first accommodation groove, the second portion ends at a second side of the handle opposite to the first side and is configured to be fixed or attached to a fixing member in the second accommodation groove when the second portion is withdrawn from the second accommodation groove, the second accommodation groove includes a second space in which the second portion is insertable, and the fixing member extends beyond a front surface of the refrigerator from an inside surface of the second accommodation groove.

2. The refrigerator of claim 1, wherein:

the storage space comprises a cold room and a freezing room, the door comprises a cold room door and the refrigerator further comprises a freezing room door, the freezing room door comprising a third accommodation groove on or in one side of the freezing room door and a fourth accommodation groove on or in another side of the freezing room door, the cold room door includes the first handle, and the freezing room door includes a second handle comprising a third portion configured to be rotatably fixed or attached to a second pivot in the third accommodation groove and a fourth portion in the fourth accommodation groove or withdrawn from the fourth accommodation groove by rotation of the third portion.

3. The refrigerator of claim 1, wherein:

the first accommodation groove is adjacent or near to an upper or lower side or end of the main body, and the second accommodation groove is adjacent or near to a center of the main body.

4. The refrigerator of claim 1, wherein:

the second portion is configured to move when the second portion surrounds the fixing member, and the second portion is fixed or attached to the fixing member by a fastening member when the second portion is drawn out from the second accommodation groove.

5. The refrigerator of claim 1, wherein:

the second portion is configured to move when the second portion surrounds the fixing member, and the second portion is fixed or attached to an end of the fixing member by a fastening member when the second portion is in the second accommodation groove.

6. The refrigerator of claim 1, wherein:

the second portion comprises at least two fastening holes configured to be fixed or attached to the fixing member and spaced apart from each other, one of the fastening holes couples the second portion and the fixing member when the second portion is in the second accommodation groove, and another one of the fastening holes couples the second portion and the fixing member when the second portion is withdrawn from the second accommodation groove.

7. A refrigerator configured to store food at low temperature, comprising:

a main body having a storage space configured to store the food;

a door configured to selectively open and shield or close the storage space of the main body; and a handle having a first end or side rotatably fixed to the door and a second end or side adjacent or near to or distant from a front side of the door, wherein the first end or side is connected to a pivot in a first accommodation groove on or in a first section of the door, the first accommodation groove includes a first space in which the first end or side of the handle is insertable and rotatable, the second end or side is in or withdrawn from a second accommodation groove on or in a second section of the door, the second accommodation groove includes a second space in which the second end or side of the handle is insertable, the first pivot is horizontal and intersects the first accommodation groove, and the handle is in a first state when the second end or side is adjacent or near to the front side of the door and in a second state when the second end or side is far or away from the front side of the door, when the refrigerator is packaged, the handle is in the first state, and when the refrigerator is installed or in use, the handle is in the second state and is fixed to the door.

8. The refrigerator of claim 7, wherein:

the second end or side includes a guide extending toward the door, the second accommodation groove includes a space in which the guide is movable, and the guide is fixed or attached to a fixing member extending from an inside surface of the second accommodation groove by a fastening member in the second state.

9. The refrigerator of claim 8, wherein:

an end of the fixing member extends beyond the front side of the door, and the fastening member is coupled to the end of the fixing member.

10. The refrigerator of claim 7, wherein the handle is fixed to the door when the handle is in the first state.

11. The refrigerator of claim 7, wherein:

the storage space comprises a cold room and a freezing room, the door comprises a cold room door, and the refrigerator further comprise a freezing room door, the cold room door includes the handle, the freezing room door has a second handle having a first end or side rotatably fixed to the freezing room door and a second end or side adjacent or near to or distant from a front side of the freezing room door, wherein the second handle is in the first state when the second end or side thereof is adjacent or near to the front side of the freezing room door and in the second state when the second end or side thereof is far or away from the front side of the freezing room door, and the first end or side of the handle is adjacent or near to an upper or lower side or end of the main body.

* * * * *